US005639225A

United States Patent [19]

Matsuda et al.

[11] Patent Number: 5,639,225

[45] Date of Patent: Jun. 17, 1997

[54] SCROLL TYPE COMPRESSOR

[75] Inventors: Mikio Matsuda; Mitsuo Inagaki, both of Okazaki; Takeshi Sakai, Chiryu, all of Japan

[73] Assignees: Nippondenso Co., Ltd., Kariya; Nippon Soken, Inc., Aichi, both of Japan

[21] Appl. No.: 705,039

[22] Filed: Aug. 30, 1996

Related U.S. Application Data

[63] Continuation of Ser. No. 452,175, May 26, 1995, abandoned.

[30] Foreign Application Priority Data

May 30, 1994 [JP] Japan ..... 6-116683

[51] Int. Cl.[6] ..... F04B 49/02

[52] U.S. Cl. ..... 417/299; 417/308; 417/310

[58] Field of Search ..... 417/299, 304, 417/308, 310

[56] References Cited

U.S. PATENT DOCUMENTS

| | | | |
|---|---|---|---|
| 4,383,805 | 5/1983 | Teegarden et al. | 417/308 |
| 5,074,760 | 12/1991 | Hirooka et al. | 417/304 |
| 5,192,195 | 3/1993 | Iio et al. | 417/299 |
| 5,193,987 | 3/1993 | Iio et al. | 417/299 X |
| 5,451,146 | 9/1995 | Inagaki et al. | 417/308 X |

FOREIGN PATENT DOCUMENTS

| | | |
|---|---|---|
| 61-291792 | 12/1986 | Japan . |
| 62-91680 | 4/1987 | Japan . |
| 3237285 | 10/1991 | Japan . |
| 5332263 | 12/1993 | Japan . |

*Primary Examiner*—Richard E. Gluck

*Attorney, Agent, or Firm*—Cushman Darby & Cushman, IP Group of Pillsbury Madison & Sutro, L.L.P.

[57] ABSTRACT

In a scroll type compressor, when the operation of the compressor is stopped, compression chambers, for compressing a fluid, and a suction chamber are communicated with each other through bypass holes, and a spool valve to open and close the holes, so that the pressure in the compression chambers are lowered and the occurrence of a shock caused by a sharp increase in the load is prevented at the next start. Since the discharge pressure to drive the spool valve is introduced from a position upstream of the discharge valve, pressure is quickly lowered when the compressor stops, so that the spool valve can be quickly opened. Therefore, even when the compressor is frequently started and stopped, the occurrence of a shock can be positively prevented when the compressor starts.

3 Claims, 5 Drawing Sheets

SCROLL TYPE COMPRESSOR

This application is a continuation of application Ser. No. 08/452,175, filed May 26, 1995, now abandoned.

BACKGROUND OF THE INVENTION

1. Field of the Invention

The present invention relates to a scroll type compressor, and more particularly relates to a scroll type compressor effectively used as a refrigerant compressor in an air conditioner for automobile use.

2. Description of the Related Art

Conventionally, there are provided variable discharge compressors of the scroll type which are disclosed in Japanese Unexamined Patent Publication Nos. 61-291792, 62-91680 and 5-332263. The operation of these variable discharge compressors is as follows:

Bypass holes communicated with the suction chamber through the intermediate pressure chamber are formed on the end plate of the fixed scroll member. An opening and closing valve mechanism is provided in the communicating section between the intermediate pressure chamber and the suction chamber. This opening and closing valve mechanism is controlled by an electric means such as a solenoid valve or motor, so that the bypass hole is opened and closed, and the variable discharge operation can be accomplished.

According to the variable discharge compressor of scroll type disclosed in Japanese Unexamined Patent Publication 3-237285, a piston in the opening and closing valve mechanism causes gas, in the middle of the compression cycle, to flow to the suction chamber side through a bypass hole. This piston is moved when the discharge pressure of refrigerant flowing in the downstream of the discharge valve is applied.

SUMMARY OF THE INVENTION

A refrigerant compressor in an air conditioner for automobile use is driven by a belt directly connected with an automobile engine through an electromagnetic clutch. When the electromagnetic clutch is connected or disconnected, the refrigerant compressor is driven or stopped. Therefore, shocks are applied to the automobile by the fluctuation of the load caused when the refrigerant compressor is started and stopped, causing passenger discomfort. When the variable discharge compressor of the prior art described above is used, the compressor is controlled in such a manner that a small amount of gas is discharged at the start of the compression so that the load fluctuation can be reduced. In this way, the problem can be solved in the variable discharge compressor of the prior art.

However, in the variable discharge compressors of scroll type disclosed in the three Japanese Unexamined Patent Publications described before, it is necessary to provide an opening and closing valve mechanism and an electric means for controlling it such as a solenoid valve or motor. Accordingly, the scroll type compressor is expensive, and the structure is complicated. Recently, there is a demand for automobiles in which excessive equipment is removed and costs are reduced. Accordingly, the need exists for a refrigerant compressor of simple structure and low cost for which a variable discharge mechanism is not needed.

In the opening and closing valve mechanism of the scroll type compressor disclosed in Japanese Unexamined Patent Publication No. 3-237285, a piston is controlled by the pressure of refrigerant introduced from the discharge chamber downstream of the discharge valve. Accordingly, even if the compressor is stopped, the pressure in the discharge chamber is not lowered immediately. Therefore, the piston motion is delayed, and a time delay occurs before the bypass holes are opened. Consequently, according to the prior art described above, under conditions where starting and stopping of the refrigerant compressor are repeated in a short period of time, it is difficult to prevent shocks caused when the refrigerant compressor starts. It is desirable to solve the above problems.

The present invention is provided to meet the objects described above. It is an object of the present invention to provide a scroll type compressor, of a simple structure, in which load fluctuations are reduced when the compressor starts, so that the shocks given to the automobile are reduced.

In order to accomplish the above object, the present invention provides a scroll type compressor comprising:

- a fixed scroll member having an end plate and a volute member provided on the end plate;
- a movable scroll member having an end plate and a volute member provided on the end plate, the movable scroll member being assembled so that the movable scroll member is engaged with the fixed scroll member under the condition that a center of the movable scroll member is shifted from that of the fixed scroll member;
- a shaft for revolving the movable scroll member in an orbital motion;
- a locking mechanism to allow only an orbiting motion of the movable scroll member and to stop any rotary motion, wherein compression chambers formed between the movable and fixed scroll members move to the center of the volute member while the volumes of the compression chambers are reduced, in accordance with the orbiting motion of the movable scroll member, so as to compress a fluid in the compression chambers, the scroll type compressor further comprising:

- a cylindrical space formed on the end plate of the fixed scroll member, the cylindrical space being communicated with a suction chamber;
- a group of bypass holes for communicating the compression chambers with the cylindrical space;
- a spool valve for opening and closing the group of bypass holes, the spool valve being slidably provided in the cylindrical space;
- a pushing means for pushing the spool valve to open the group of bypass holes so as to communicate the compression chambers with the suction chamber, the pushing means coming into contact with the spool valve;
- a pressure introducing hole for introducing the discharge pressure so that a force can be given to the spool valve in the direction to close the group of bypass holes, wherein the pressure introducing hole is communicated with a discharge hole on the end plate of the fixed scroll member at a position upstream of a discharge valve.

When the compressor is stopped in an operating condition, pressure upstream of the discharge valve is quickly lowered. Therefore, the group of bypass valves are quickly opened by the action of the pushing means. As a result, the compression chambers are communicated with the suction chamber through the cylindrical space without a time delay. Therefore, the compressor capacity is substantially reduced. For this reason, even if the compressor is restarted after a short period time has passed from the stoppage, the fluctuation of a load given to the compressor is reduced. On the other hand, when the compressor is restarted and the discharge pressure is increased, the spool valve is gently moved by this discharge pressure in a direction of closing the group of the bypass holes. In this way, the compressor is put into a state of full operation.

Accordingly, even when the compressor is in any state of operation, shocks given to a vehicle can be reduced by a simple structure which includes bypass holes, a spool valve and a pushing means.

Other objects and advantages of the present invention will be more apparent to those skilled in the art after considering the accompanying drawings and the following specification in which several exemplary embodiments of the invention are disclosed.

DESCRIPTION OF THE PREFERRED EMBODIMENTS

Figure 1:
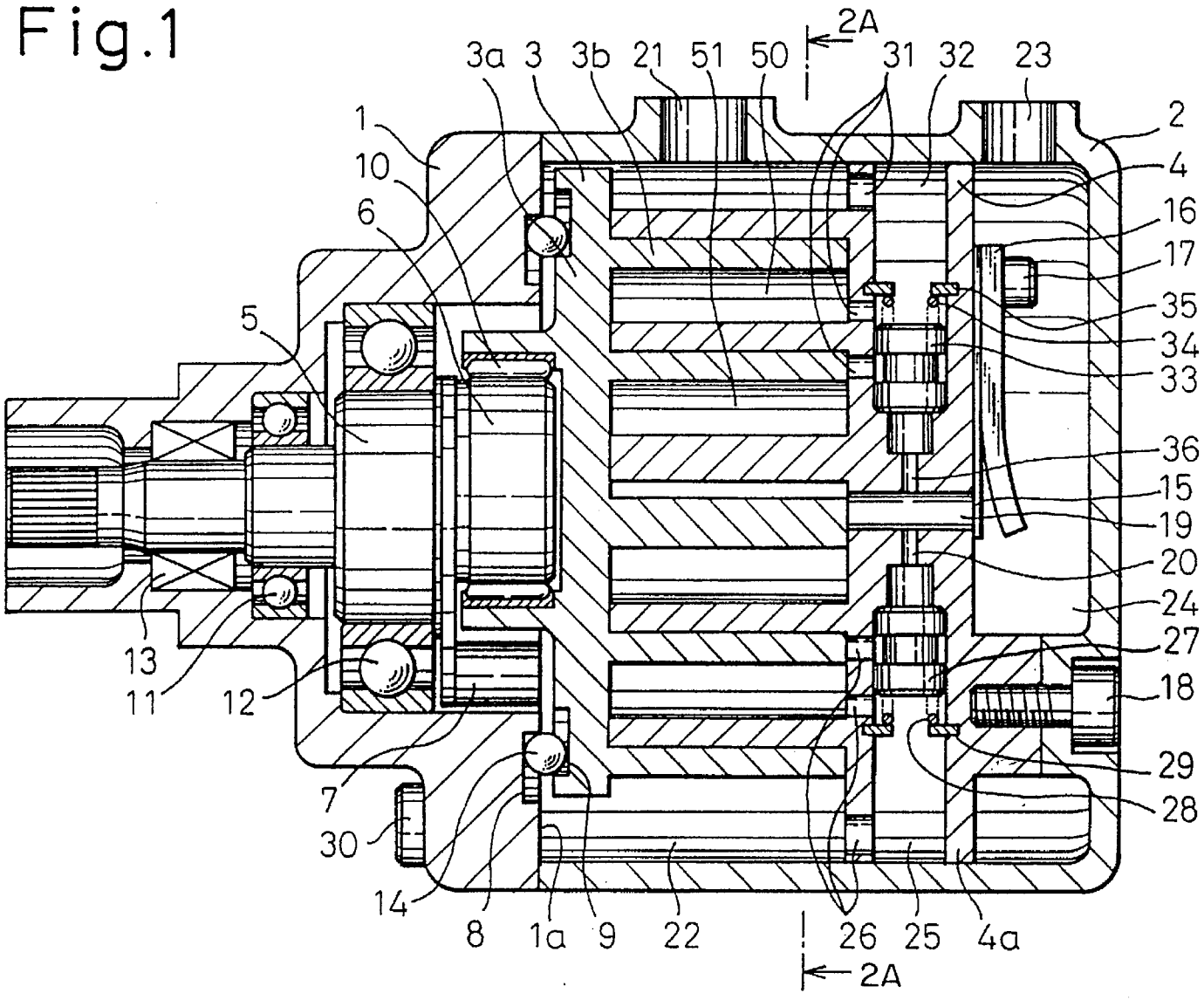
FIG. 1 is a cross sectional view of the scroll type compressor of the first embodiment of the present invention.

With reference to FIG. 1, an arrangement of the scroll type compressor of the first embodiment of the present invention will be explained in detail as follows. A rotational shaft 5 is rotatably supported by bearings 11, 12 held by a front housing 1. A crank section 6 is provided at an end of the rotational shaft 5, the crank section 6 being eccentric to the center of the rotational shaft by a predetermined eccentricity. A movable scroll member 3 is rotatably supported by the crank section 6 through a bearing 10. A plurality of balls 14 are held between a circular hollow 9 formed on an end plate 3*a* of the movable scroll member 3 and a circular hollow 8 formed on an end surface 1*a* of the front housing 1. Therefore, rotation of the movable scroll member 3 can be prevented. Accordingly, the movable scroll member 3 orbits when the rotational shaft 5 is rotated.

A balance weight 7 is mounted on the rotational shaft 5 to compensate for a dynamic unbalance caused by the eccentricity of the movable scroll member 3 and crank section 6. A shaft seal 13 is provided between the front housing 1 and the rotational shaft 5. The shaft seal 13 prevents the refrigerant and lubricant sealed into the compressor from leaking out.

A fixed scroll member 4 is fixed to the rear housing 2 by bolts 18, and a discharge valve 15 together with a valve stop plate 16 is mounted on the fixed scroll member 4 by bolts 17. The rear housing 2 is fixed to the front housing 1 by bolts 30. In the rear housing 2, there are provided a suction port 21 and discharge port 23. The suction port 21 and discharge port 23 are partitioned by an end plate 4*a* of the fixed scroll member 4. In FIG. 1, the outermost space on the left of the end plate 4*a* of the fixed scroll member 4 is a suction chamber 22, and a space on the right is a discharge chamber 24.

A cylindrical space 25 is formed in the end plate 4*a* of the fixed scroll member 4. A spool valve 27 is slidably provided in the cylindrical space 25. This spool valve 27 opens and closes a plurality of bypass holes 26 formed on the end plate 4*a*, and the refrigerant in the compression chamber is able to flow into the suction chamber 2 through the cylindrical space 25. In this case, there is provided a spring 28, which is the pushing means of the present invention, in the cylindrical space 25, wherein the spring 28 comes into contact with the spool valve 27 and gives a force to the spool valve 27 in a direction of opening the group of bypass holes 26. The cylindrical space 25 is communicated with the discharge hole 19 through a pressure introducing hole 20 at a position located upstream of the discharge valve 15. Therefore, the discharge pressure is introduced onto one side of the spool valve 27 which is opposite to the other side of the spool valve 27 which comes into contact with the spring 28. Reference numeral 29 is an engaging means such as a snap ring, which functions as a stopper for the spring 28.

In the same manner, a cylindrical space 32, a group of bypass holes 31 and a pressure introducing hole 36, on an opposed side with respect to the discharge hole 19, are provided. In the cylindrical space 32, a spool valve 33, a spring 34 and a stopper 35 are provided. In the same manner as described before, the spool valve 33 opens and closes the group of bypass holes 31.

In this connection, the spaces 25, 32 described above are not necessarily cylindrical. As long as the spool valves 27, 33 may be slid in the spaces, other configurations can be adopted, for example, an ellipse or a rectangle may be adopted.

Figure 2A:
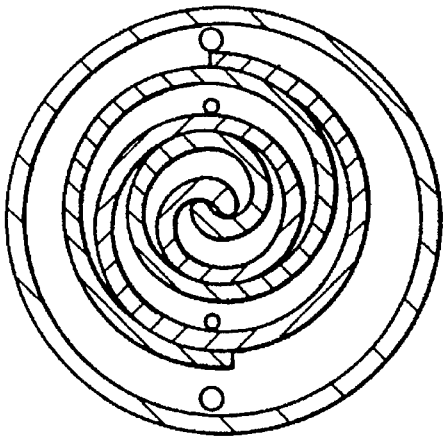
FIGS. 2A–2D are schematic illustrations for explaining the operation of the scroll type compressor of the first embodiment.
Figure 2B:
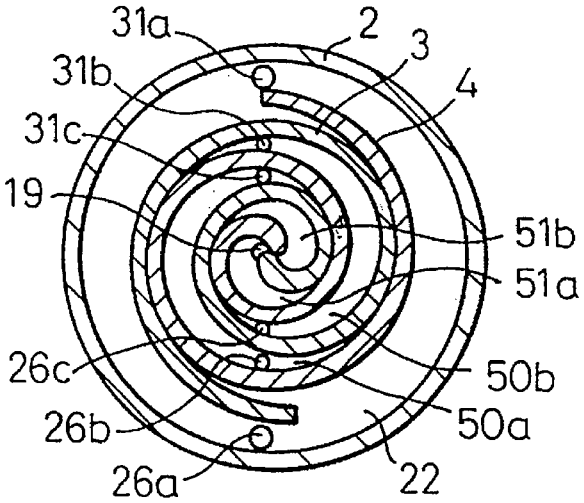
Figure 2D:
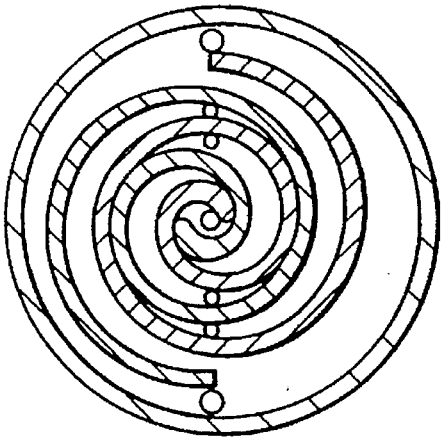
Figure 2C:
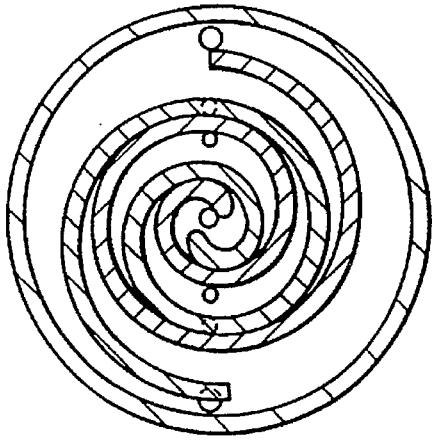
Figure 3A:
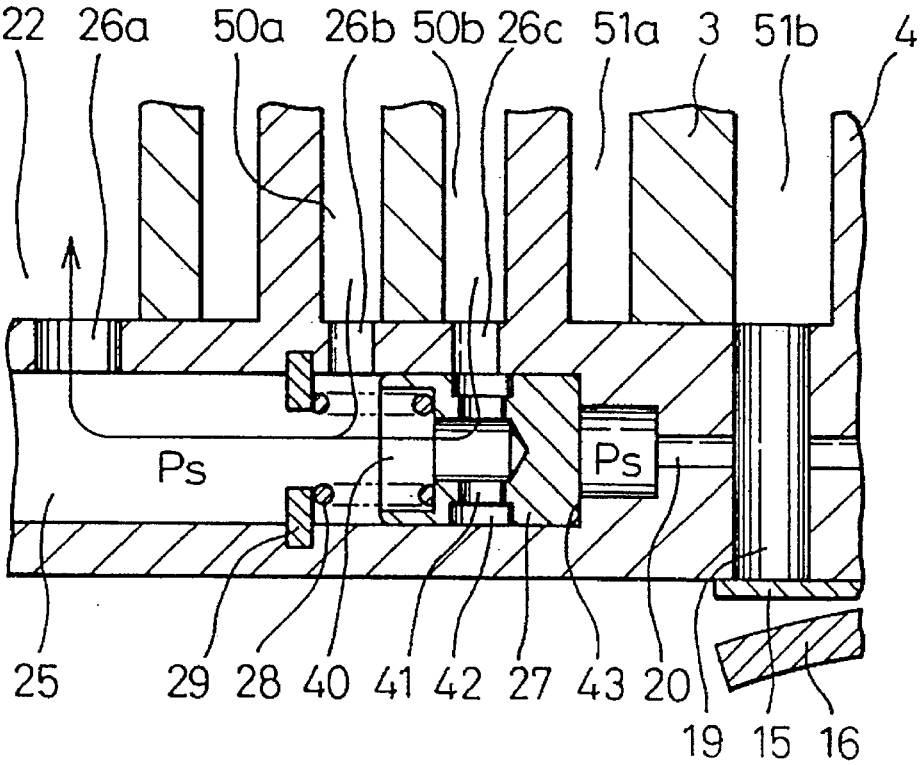
FIG. 3A is a schematic illustration for explaining one state of operation of the first embodiment of the present invention.
Figure 3B:
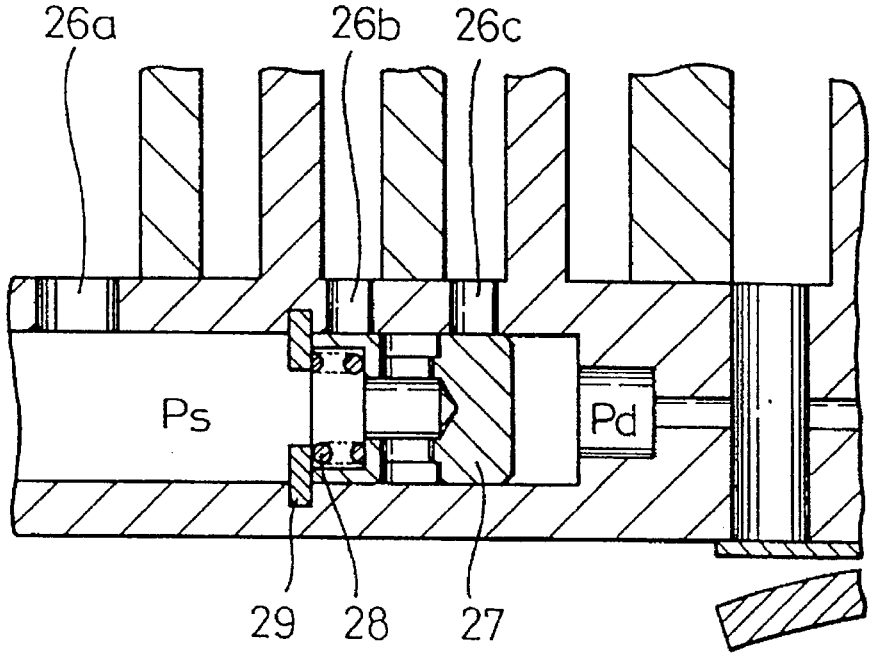
FIG. 3B is a schematic illustration for explaining another state of operation of the first embodiment of the present invention.
Figure 4A:
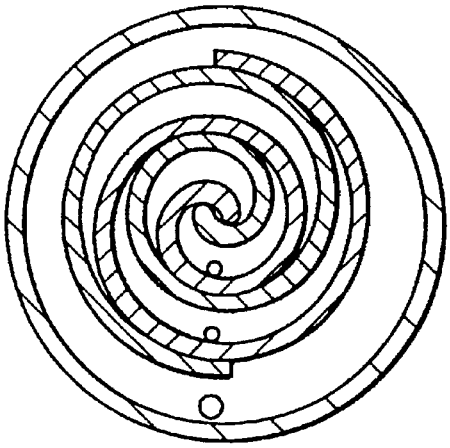
FIGS. 4A–4D is a schematic illustration for explaining the operation of the scroll type compressor of the second embodiment of the present invention.
Figure 4B:
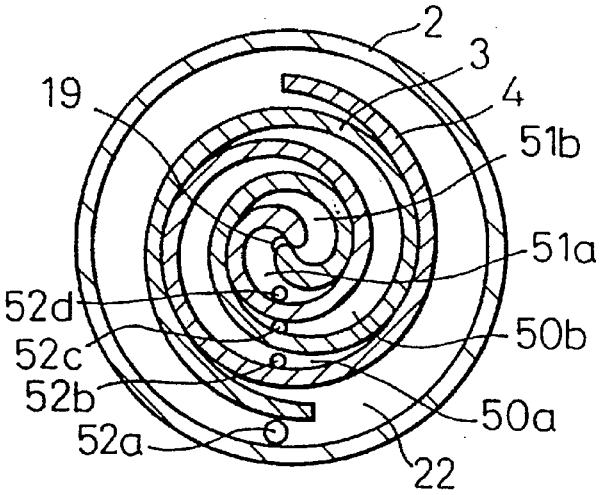
Figure 4D:
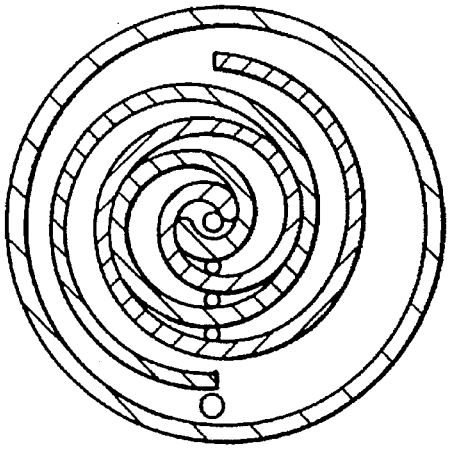
Figure 4C:
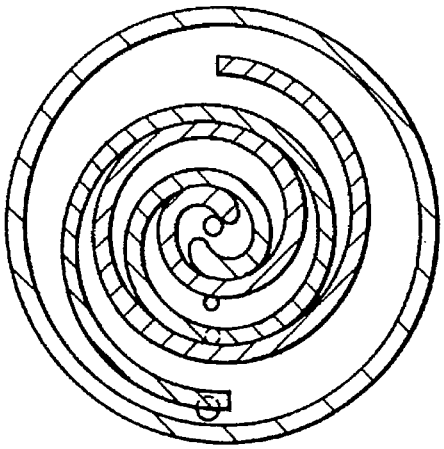

Next, with reference to FIGS. 2A–2D and 3, the operation of the first embodiment will be explained below. FIGS. 2A–2D are cross sectional views taken on line 2A—2A in FIG. 1. In FIG. 2A, there is shown a state of the movable scroll member 3 in which the suction of refrigerant has been completed, and also there are shown other states in FIGS. 2B–2D, each of which shows a state of the movable scroll member 3 orbited by an angle 90°, that is, the entire drawing shows four states of the movable scroll member 3 in one orbit. FIGS. 3A and 3B are cross sectional views showing the cylindrical space 25 and its periphery. FIG. 3A shows a state in which the spool valve 27 opens the group of bypass holes 26, and FIG. 3B shows a state in which the spool valve 27 closes the group of bypass holes 26.

When the compressor is stopped, the refrigerant is not compressed, so that the pressure in the discharge hole 19 is equal to suction pressure $P_s$ as illustrated in FIG. 3A. Therefore, the spool valve 27 is not given a force by the pressure of the refrigerant, but only a pushing force is given to the spool valve 27 by the spring 28. Accordingly, the spool valve 27 is moved to the right in the drawing until it comes into contact with a step portion 43 of the circular hole forming the cylindrical space 25. At this time, the refrigerant in the compression chamber 50*a* passes through the bypass hole 26*b* and flows into the cylindrical space 25. Then the refrigerant passes through the bypass hole 26*a* and returns to the suction chamber 22. Also, the refrigerant in the compression chamber 50*b* passes through the bypass hole 26*c*, groove section 42 formed on the outer circumference of the spool valve 27, communication hole 41 communicated with the hole 40 formed in the spool valve 27 in the axial direction, hole 40, cylindrical space 25 and bypass hole 26*a*. After that, the refrigerant returns to the suction chamber 22. The spool valve 33 conducts the same action on the bypass hole 31. As a result, the suction volume of the compressor is substantially reduced, and the volume of the compression chamber 51 under the condition that the bypass holes 26*c*, 31*c* are closed by the volute member 3*b* of the movable scroll member 3 as shown in FIG. 2A, is approximately 30% of the maximum suction volume of the compression chamber 51.

Consequently, even when the compressor is started under the above condition, the load is not sharply increased at the start of the compressor since the substantial suction volume is small. Therefore, the fluctuation of the load is small and the shock given to the vehicle is small.

Next, the compressor is started and the refrigerant is compressed. The pressure in the discharge hole 19 is then increased to a discharge pressure $P_d$ higher than the suction pressure $P_s$ as shown in FIG. 3B. Therefore, this discharge pressure acts on the spool valve 27 through the pressure introducing hole 20, and a differential pressure of the discharge pressure $P_d$ and suction pressure $P_s$ acts on the spool valve 27, so that the spool valve 27 moves to the left in the drawing until it comes into contact with the stopper 29. At this time, the group of bypass holes 26 are closed by the spool valve 27, and also the group of the bypass holes 31 are closed by the spool valve 33 in the same manner.

As described above, since the bypassing operation is not carried out in the compressor, the suction capacity becomes 100%, that is, the compressor exhibits its full capacity.

According to the mode of operation described above, the fluctuation of the load at the start of the compressor can be reduced by the simple structure including the bypass hole and spool valve. Therefore, it is possible to reduce the shock given to the vehicle.

According to the features of the present invention, in the first embodiment, the pressure introducing hole 20 of the cylindrical space 25 is communicated with the discharge hole 19 upstream of the discharge valve 15. Accordingly, while the discharge valve 15 is closed and the pressure in the discharge chamber 24 is gradually lowered at the stop of the compressor operation, the pressure in the discharge hole 19 and pressure introducing hole 20 is sharply lowered. Therefore, the spool valve 27 is pushed by the spring 28 and quickly moved, so that the compression chamber 50 and the suction chamber 22 are communicated with each other in a short period of time, and the pressure in the compression chamber 50 is lowered. Consequently, compared with the fourth prior art (Japanese Unexamined Patent Publication No. 3-237285), the pressure in the compression chamber 50 is quickly lowered at the stop of the compressor. Accordingly, even when the compressor is restarted after a short stoppage of operation, that is, in the actual vehicle running condition in which the compressor is frequently turned on and off, the shock given to the vehicle at the start of the compressor can be reduced.

In the first embodiment explained before, two groups of bypass holes 26, 31 are provided for bypassing the refrigerant from each of the pair of compression chambers (for example 50*a* and 50*b*, or 51*a* and 51*b*) in the same manner, and these two groups of bypass holes are opened and closed by different spool valves 27, 33. Next, the second embodiment of the scroll type compressor will be explained, by which the approximately same effect as that of the first embodiment can be provided when one group of bypass holes are opened and closed by a single spool valve.

In the third prior art described before, that is, in Japanese Unexamined Patent Publication No. 5-332263, the present inventors provide one group of bypass holes and a single spool valve to open and close them as a means for changing the discharge capacity of the scroll compressor. The second embodiment in which the aforementioned opening and closing valve mechanism is applied to the present invention is shown in FIGS. 4A–4D, 5A and 5B. In this case, FIGS. 5A and 5B correspond to FIGS. 3A and 3B. In the example shown in FIGS. 4A–4D, four bypass holes 52*a*, 52*b*, 52*c* and 52*d* are aligned on a straight line. However, when an angular position of the straight line, positions of the three bypass holes 52*b*, 52*c*, 52*d*, and diameters of the bypass holes are appropriately selected, it is possible to compose the apparatus in such a manner that these three bypass holes are open to the pairs of compression chambers 50*a* and 50*b*, and compression chambers 51*a* and 51*b*.

Figure 5A:
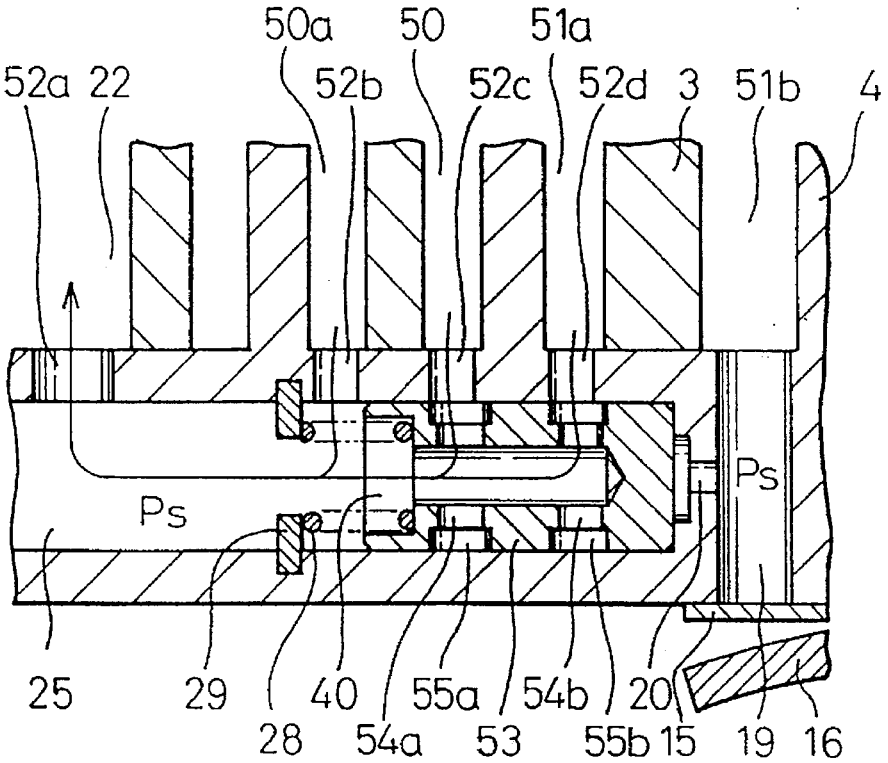
FIG. 5A is a schematic illustration for explaining one state of operation of the second embodiment of the present invention.
Figure 5B:
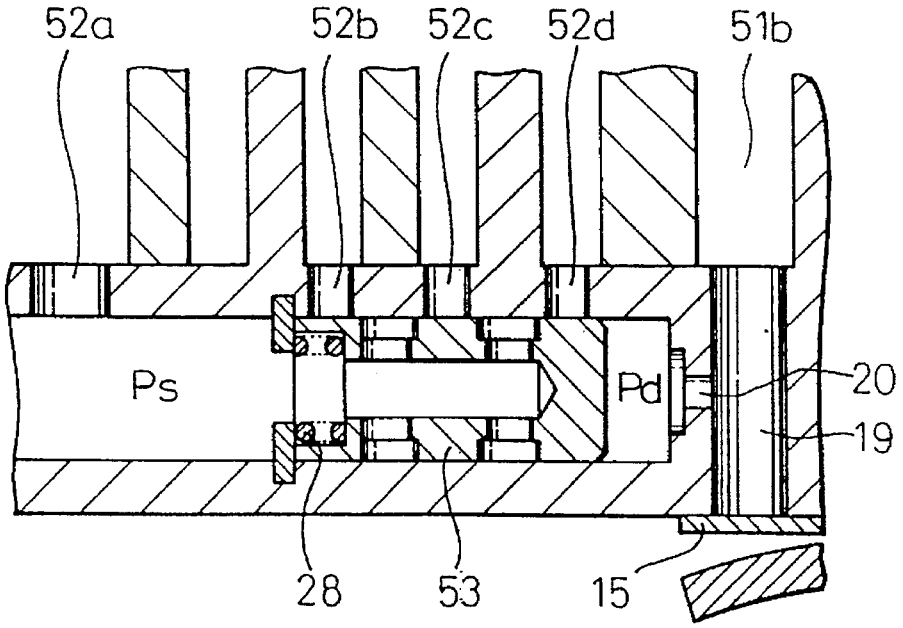
FIG. 5B is a schematic illustration for explaining another state of operation of the second embodiment of the present invention.

At least three bypass holes 52*b*, 52*c*, 52*d* are provided at the aforementioned positions, and each bypass hole is open to the single cylindrical space 25 communicated with the suction chamber 22, and these bypass holes are simultaneously opened and closed by the single spool valve 53 illustrated in FIG. 5A. FIG. 5A shows a valve opening state in which a number of compression chambers 50, 51 are simultaneously communicated with the suction chamber 22 through four bypass holes 52*a*, 52*b*, 52*c*, 52*d* to which a bypass hole open to the suction chamber 22 is added, and also communicated with the suction chamber 22 through a hollow spool valve 53. In this state, the discharge capacity of the compressor is minimized. FIG. 5B shows a state of the closed valve in which the communication is intercepted, that is, FIG. 5B shows a running state in which the discharge capacity of the compressor is maximum.

As illustrated in FIGS. 5A and 5B, also in the second embodiment, according to the features of the present invention, the pressure introducing hole 20 in the cylindrical space 25 is communicated with the discharge hole 19 located upstream of the discharge valve 15. Therefore, the primary mode of operation and effect of the second embodiment are approximately the same as those of the first embodiment. Therefore, tautological explanations will be omitted here.

We claim:

1. A scroll type compressor comprising:

a fixed scroll member having an end plate, a volute member provided on the end plate, and a central discharge hole in the end plate;

a movable scroll member having an end plate and a volute member provided on the end plate, said movable scroll member being assembled so that said movable scroll member is engaged with said fixed scroll member under the condition that a center of said movable scroll member is shifted from that of said fixed scroll member;

a shaft for revolving said movable scroll member in an orbital motion;

a locking mechanism to allow only an orbiting motion of said movable scroll member and to prevent rotary motion, wherein compression chambers formed between said movable and fixed scroll members move to the center of the volute member while the volumes of said compression chambers are reduced in accordance with the orbiting motion of said movable scroll member so as to compress a fluid in said compression chambers to a discharge pressure when each of said compression chambers reaches the center of the volute member;

a discharge valve for controlling discharge of the compressed fluid from the central discharge hole;

a space formed on the end plate of said fixed scroll member, said space being communicated with a suction chamber;

a group of bypass holes for communicating said compression chambers with said space;

a spool valve for opening and closing said group of bypass holes, said spool valve being slidably provided in said space;

a pushing means for pushing said spool valve to open said group of bypass holes so as to communicate said compression chambers with said suction chamber, said pushing means coming into contact with said spool valve;

a pressure introducing passage formed in said end plate of said fixed scroll member extending radially from said central discharge hole, said pressure introducing passage connecting said central discharge hole directly with said space for introducing the discharge pressure so that a force is applied radially outwardly to said spool valve in a direction to close said group of bypass holes, wherein said pressure introducing hole is communicated with said central discharge hole on the end plate of said fixed scroll member at a position upstream of said discharge valve, so that when the compressor is operating, fluid in said central discharge hole is at discharge pressure to hold said spool valve in a position to close said group of bypass holes, and when the compressor is stopped, fluid in the central discharge hole is at less than discharge pressure and said spool valve is quickly urged by said pushing means into a position to open said group of bypass holes so that said compression chambers are in communication with said space and said suction chamber to quickly lower pressure in said compression chambers.

2. The scroll type compressor according to claim 1, wherein said pushing means includes a spring.

3. The scroll type compressor of claim 1, further comprising:

a second space formed on the end plate of said fixed scroll member, said second space being communicated with said suction chamber and being disposed oppositely on said end plate with respect to said first mentioned space;

a second group of bypass holes for communicating said compression chambers with said second space;

a second spool valve for opening and closing said second group of bypass holes, said second spool valve being slidably provided in said second space;

a second pushing means for pushing said second spool valve to open said second group of bypass holes so as to communicate said compression chambers with said suction chamber, said second pushing means coming into contact with said second spool valve;

a second pressure introducing passage formed in said end plate of said fixed scroll member extending radially from said central discharge hole, said pressure introducing passage connecting said central discharge hole directly with said second space for introducing the discharge pressure so that a force is applied radially outwardly to said second spool valve in a direction to close said second group of bypass holes.

* * * * *